US008177451B2

(12) United States Patent
Park

(10) Patent No.: US 8,177,451 B2
(45) Date of Patent: May 15, 2012

(54) ADHESIVE DISPENSER

(76) Inventor: Joon Park, Glendale, CA (US)

( * ) Notice: Subject to any disclaimer, the term of this patent is extended or adjusted under 35 U.S.C. 154(b) by 1037 days.

(21) Appl. No.: 11/699,642

(22) Filed: Jan. 29, 2007

(65) Prior Publication Data

US 2007/0127978 A1 Jun. 7, 2007

Related U.S. Application Data

(63) Continuation-in-part of application No. 10/764,085, filed on Jan. 23, 2004, now Pat. No. 7,168,877.

(51) Int. Cl.
*B05C 11/00* (2006.01)

(52) U.S. Cl. ..... 401/266; 401/5; 401/193; 401/261

(58) Field of Classification Search ..... 401/5, 9, 401/193, 261, 266; 222/567
See application file for complete search history.

(56) References Cited

U.S. PATENT DOCUMENTS

| | | | | | |
|---|---|---|---|---|---|
| 2,065,298 | A | | 12/1936 | Abbott | |
| 2,816,308 | A | | 12/1957 | Schultt | |
| 2,988,775 | A | * | 6/1961 | Painter et al. | 401/261 |
| 4,546,906 | A | * | 10/1985 | Vadnais | 222/502 |
| 4,669,636 | A | | 6/1987 | Miyata | |
| 5,749,498 | A | * | 5/1998 | Lavoie et al. | 222/192 |
| 5,882,133 | A | * | 3/1999 | Chao et al. | 401/266 |
| 5,984,557 | A | | 11/1999 | Fennell | |
| 6,206,963 | B1 | | 3/2001 | Abrahams | |
| 6,981,611 | B2 | * | 1/2006 | Carruth et al. | 222/1 |
| 7,086,565 | B2 | | 8/2006 | Beckwith | |
| 7,168,877 | B2 | * | 1/2007 | Park | 401/266 |
| 7,695,210 | B1 | * | 4/2010 | Martinez | 401/193 |

OTHER PUBLICATIONS

Part No. 8630 from http://www.sealantequipment.com/nozzles-and-tips.

* cited by examiner

*Primary Examiner* — Timothy L Maust

(57) ABSTRACT

The brush applicator has a tapered inner wall and inwardly extended flange inside of a nozzle, which secures a molded or crimped brush assembly. Two edge applicators apply a substantially uniform thin layer of adhesive or glue only on the edge surface of a workpiece. A first edge applicator applies glue through an exit and a second embodiment of the edge applicator has a roller with side flanges and with a reduced portion in-between. A flat surface applicator may have plural vanes and channels inside of two outer walls to distribute adhesive to a wider flat exit. A biscuit applicator applies glue on two side surfaces of elliptical slots that are formed by biscuit cutters. The glue flows through plural vanes or plural transversely positioned openings and passes to form two opposite layers of glue. A dowel applicator applies a thin substantially uniform layer of glue on the wall of a dowel-receiving hole prior to installation of dowel pins. The glue is applied using a cylindrical nozzle body with plural projections and a reduced diameter portion. A wet well prevents applicator from clogging by hardened glue. The wet well fits tightly over the cap and the entire inner space of the wet well is saturated with moisture/solvent from a water/solvent retainer. A viscous-material applicator dispenses a plurality of beads on the floor or on backside of the workpieces. The viscous-material applicator includes a nozzle that has a flat but wide exit at outlet end, wherein the nozzle has plural vanes or flow restraints to diverge the flow of adhesive to a wider outlet end that has a plurality of orifices.

12 Claims, 7 Drawing Sheets

ADHESIVE DISPENSER

CROSS REFERENCE TO RELATED APPLICATION

This application is a continuation-in-part (CIP) of U.S. patent application Ser. No. 10/764,085 entitled "ADHESIVE APPLICATOR" filed Jan. 23, 2004, the contents of which are fully incorporated by reference herein.

FIELD OF THE INVENTION

This invention is related to a dispenser for adhesive implement, and particularly to a hand-held dispenser that is easy to use, capable of providing a substantially uniform layer of fluent material, of which bonded areas provide stronger joints.

BACKGROUND OF THE INVENTION

Wooden glue is usually applied onto wood surfaces by using brushes or rollers, or by directly squeezing from the bottle through push-pull closures. Flux is applied by using brushes prior to soldering. Many different types of solvent glue or cement are applied for joining pipes that are made of many different types of material including thermoplastics, which are commonly applied by dipping brushes into a flux, solvent glue, or cement container. These methods not only result in an inconsistent layer of glue, but also require cleaning and removing the excessive dried adhesive or glue from the tools and workpieces.

When applying viscous-material onto a surface to install ceramic tiles or floor coverings, it is common practice to place a quantity of the adhesive or mortar on the surface and then to spread the adhesive or mortar with a notched trowel in order to generate beads that are spaced apart. This procedure is time-consuming and inefficient, and requires a substantial amount of clean-up work.

SUMMARY OF THE INVENTION

This invention relates to adhesive dispensers including wood workpieces. For example, it relates to the provision of substantially uniform layer of adhesive or glue on the surfaces that are to be joined.

In an exemplary embodiment according to the present invention, a brush applicator implement for dispensing liquid is provided. The brush applicator implement includes a cap mountable to a bottle and has a tapered nozzle to hold a brush assembly. The brush assembly is secured inside of tapered nozzle and/or inwardly extending flange and has either molded resin ring or crimped sheet metal ring. The molded resin ring or crimped sheet metal ring has a through hole through which various amounts of liquid flow on the workpiece upon squeezing the bottle, wherein horsehair bristles are held by said either molded resin or metal ring.

In another exemplary embodiment according to the present invention, a cap having a check valve for dispensing liquid is provided. Installation of the check valve within a central opening of the nozzle prevents liquid from flowing out freely. Further embodiments may include an interchangeable nozzle that may be mounted on an axial extension from the cap with or without check valve disposed in the cap.

In yet another exemplary embodiment according to the present invention, an edge applicator implement for dispensing a substantially uniform layer of adhesive on the edge of workpiece is provided. The edge applicator implement includes a cap mountable to a bottle. The cap has a nozzle and a detachably mounted guide assembly to dispense adhesive on the edge of workpiece, wherein said nozzle comprises a U-shaped flat end plane that rests on the edge of workpiece to prevent over-spilling of adhesive laterally and a notch for the flow of glue longitudinally, wherein said flat end plane is angled between approximately 30° and approximately 75° from the nozzle, wherein external surface of said nozzle is configured to mount a detachable guide assembly.

In still another exemplary embodiment according to the present invention, a roller applicator implement for dispensing a substantially uniform layer of adhesive on the edge or flat surface of workpiece is provided. This edge applicator implement includes a cap mountable to a bottle. The cap has a roller connected by brackets extending from the cap and one pair of detachably mounted guides, wherein said roller is recessed from two side circular flanges, and adhesive is transferred by movement of roller upon squeezing of the bottle to the edge of workpiece.

In still another exemplary embodiment according to the present invention, a flat surface applicator implement for dispensing a substantially uniform layer of adhesive on the surface of workpiece is provided. The surface applicator implement includes a cap mountable to an adhesive bottle. The cap has a flat but wide nozzle, wherein said nozzle has plural vanes to diverge the flow of adhesive to a wider exit onto the surface of workpiece.

In still another exemplary embodiment according to the present invention, a biscuit applicator implement for dispensing a substantially uniform layer of adhesive on two side surfaces of an elliptical slot is provided. The biscuit applicator implement includes a cap mountable to an adhesive bottle. The cap has two wide walls whose end has an elliptical shape, plural vanes and flow channels between the two walls, plural passes at the end, and plural projections on outside of two walls, wherein glue flows through said channels formed by said vanes and through passes and fills the space defined by projections between the outer walls and each side of elliptical slot walls formed by the biscuit cutter.

In still another exemplary embodiment according to the present invention, a biscuit applicator implement for dispensing a substantially uniform layer of adhesive on two side surfaces of an elliptical slot is provided. The biscuit applicator implement includes a cap mountable to a bottle. The cap has two wide walls whose end is elliptical shape, a pathway between two walls, transversely positioned orifices to the walls and plural projections on outside of two walls, wherein adhesive flows through said orifices and fills the space defined by projections between the outer walls and each side of elliptical slot wall formed by the biscuit cutter.

In still another exemplary embodiment according to the present invention, a dowel applicator implement for dispensing a substantially uniform layer of adhesive on the wall of dowel-receiving hole is provided. The dowel applicator implement includes a cap mountable to a bottle. The cap has a cylindrical nozzle, transversely positioned orifice, two yokes that connect the nozzle and a tip, wherein said tip provides plural projections and circular recesses, wherein adhesive flows through said and onto the dowel-receiving hole wall, wherein the outside surface of said nozzle has hole depth indicia.

In still another exemplary embodiment according to the present invention, a wet well implement for the prevention of applicator tips from clogging by hardened adhesive is provided. The wet well implement includes a body comprising a cup and a water/solvent absorbent, wherein inner circumference of said cup fits tightly over the outer rim of the cap, wherein said water/solvent absorbent is placed on the cup of other end of rim to provide the inner space of the wet well saturated with moisture/solvent.

In a further exemplary embodiment according to the present invention, a viscous-material applicator implement for dispensing a plurality of beads on the floor or on backside of the workpieces. The viscous-material applicator implement includes a nozzle that has a flat but wide exit at outlet end, wherein the nozzle has plural vanes or flow restraints to diverge the flow of adhesive to a wider outlet end onto the surface of workpiece, wherein the outlet end has a plurality of orifices.

BRIEF DESCRIPTION OF THE DRAWINGS

These and other aspects of the invention may be described in reference to the following detailed description, taken in conjunction with the accompanying drawings, wherein.

DETAILED DESCRIPTION OF THE EXEMPLARY EMBODIMENTS

The adhesive or glue applicator implement in exemplary embodiments according to the present invention provides for applying adhesive easily with a squeeze of adhesive bottle, resulting in substantially uniformly controlled and substantially even layer of adhesive.

The brush applicator implement may have a brush material such as horsehair bristles molded or crimped inside sheet metal ring that is disposed inside of the nozzle with a central opening, resulting in convenient and continuous use of the brush.

Installation of a check valve disposed within the central opening of the brush assembly prevents liquid from flowing out freely. Another implement may include separable but interchangeable nozzles which may be mounted on an axial extension of the cap.

The edge applicator implements may have edge guides to dispense adhesive only on the edge surface of the workpiece.

The edge applicator and surface applicator implements in exemplary embodiments provide for substantially even and substantially uniform glue layers from a notch at aft and yet contains adhesive by a U-shaped flat end plane.

The surface and biscuit applicator implements may have plural vanes and channels inside of two outer walls to distribute adhesive to a wider exit.

The dowel applicator implement may have a tip to dispense adhesive evenly on the dowel-receiving hole, with projections and recessed circular portions, and may have indicia to measure hole depth prior to dowel insertion.

The wet well implement may have a water/solvent retainer on one end to prevent applicator tip from drying.

Figure 1:
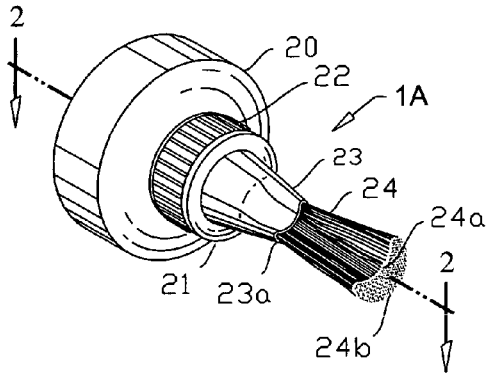
FIG. 1 is a perspective view of a first exemplary embodiment 1A of a brush applicator implement in accordance with the present invention.

A brush applicator implement 1A (or a body thereof) in a first exemplary embodiment according to the present invention is illustrated as a perspective view in FIG. 1 and as cross-sectional views in FIGS. 2A-4. The brush applicator 1A as shown in FIG. 1 is mounted on a bottle 20. A cap 22 of the applicator 1A is provided with a foot in the form of a screw to be screwed onto a threaded connecting stub of the bottle 20. The applicator 1A may include an applicator cap 1B with a molded brush assembly 1C or a crimped brush assembly 1D. The nozzle 23 may have a tapered outer wall whose circumference decreases toward the exit end (−Y axis) and inner walls 25, 25*a* and 25*b* also may be tapered.

Figure 3A:
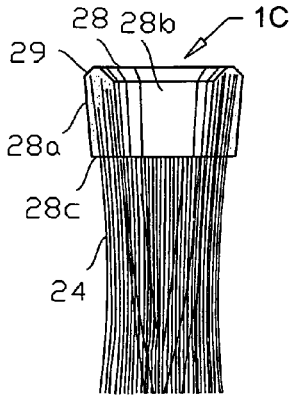
FIG. 3A is an enlarged cross-sectional view from FIG. 2A showing details of a molded brush assembly 1C.
Figure 3B:
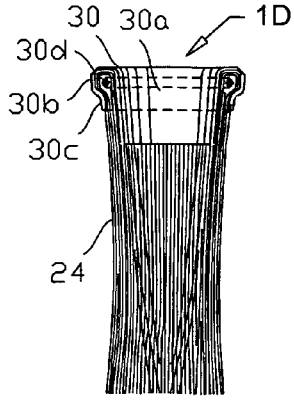
FIG. 3B is an enlarged cross-sectional view from FIG. 2A showing details of a sheet metal crimped brush assembly 1D.

A resin molded ring 28 of molded brush assembly 1C as shown in FIG. 3A may include an outer tapered wall 28*a*, a central opening 28*b*, a chamfer 29 (i.e., a beveled edge) at top and a stepped ring end 28*c*, which may hold horsehair bristles 24 within. Another sheet metal ring 30 of crimped brush assembly 1D as shown in FIG. 3B may include an outer tapered wall 30*b*, a further crimped portion 30*c*, a central opening 30*a*, which hold and secure the horsehair bristles 24 with a brush retaining ring 30*d* within.

The brush assembly 1C or 1D can be either cast or formed prior to insertion into the nozzle 23. The molded assembly 1C may also be cast within tapered inner walls 25 and 25*a*. Once the brush assembly 1C or 1D is placed inside of nozzle 23, it is secured by the shape of tapered inner walls 25 and 25*a*, an inwardly extended flange 26, a secondary inwardly extended flange 26*a* and a step 26*b*, which correspond to the shape of the brush assembly 1C and 1D. By way of example, the nature of taper stops the assembly 1C from downward movement (−Y axis), and the inwardly extended flange 26*a* associated with the chamfer 29 secures the assembly 1C from upward movement (+Y axis) as shown in FIGS. 2A and 4.

The tapered inner walls 25, 25*a* and 25*b* not only provide a liquid passage through the central opening 28*b*, but also provide dense bristle formation at near a nozzle tip 23*a*. With a squeeze of the bottle 20, the glue flows through the central opening 28*b* to the end of the horsehair bristles 24 to dispense proper amount of fluid on the workpiece corresponding to squeeze pressure. Even though the end of lateral cross section of the nozzle tip 23*a* of the body 1A is shown as a crescent, it may be round, rectangular or oval shaped. The crescent shape is useful for applying fluxes or solvents on pipes since the convex 24*b* and concave 24*a* conform to the shape of inner and outer walls of a pipe. The applicator housing 1B may be made of polymer, tin, stainless steel material or any other suitable material.

Figure 2A:
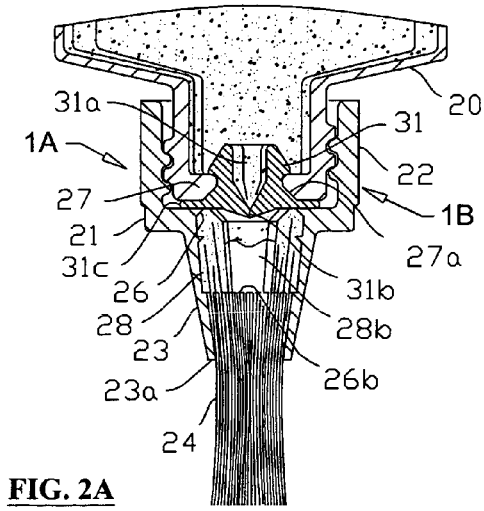
FIG. 2A is a cross-sectional view taken along line 2-2 of FIG. 1.
Figure 4:
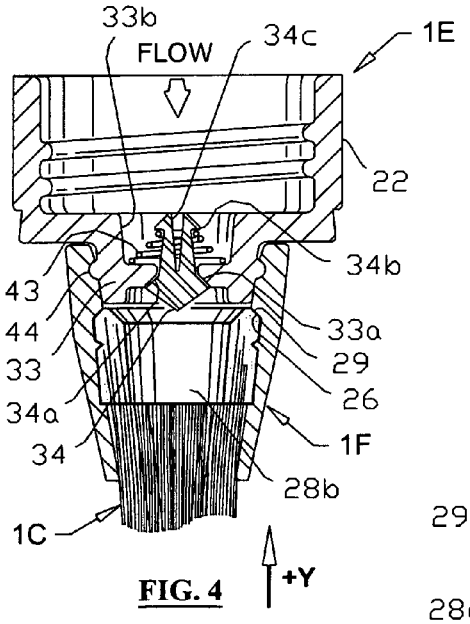
FIG. 4 is an enlarged cross-sectional view showing a modified check valve cap 1E that has a stem installed in an exit hole of a cap and an extension on which a nozzle body is mounted, wherein a brush assembly 1C is mounted in the nozzle body 1F.
Figure 2B:
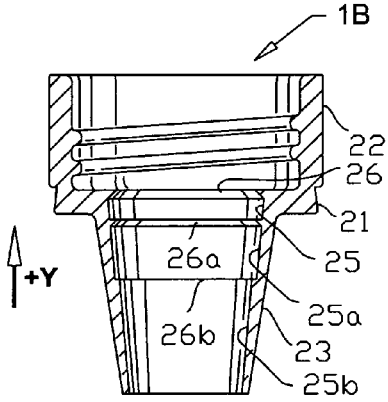
FIG. 2B is an enlarged cross-sectional view from FIG. 2A showing details of a cup 1B.

Check valve can be implemented onto the bottle 20 or onto the cap 22 as illustrated as cross-sectional views in FIGS. 2A and 4. As shown in FIG. 2A, the neck of bottle may form an inwardly extended flange 27 and an exit hole 27*a* on which a valve 31 may be mounted. A check valve 31 made of a flexible elastomer may have an annular recess and two annular extensions on its outer annular wall to fit tightly onto the hole 27. A radially extended valve flange 31C may serve as a gasket between the bottleneck and the cap 22. When the bottle 20 is pressurized, the fluid may flow through a pocket 31*a* and a slit 31*b* to reach to the brush material 24.

As shown in FIG. 4, a check valve cap 1E includes a cap 22 and a nozzle body 1F. The cap 22 may have an axial extension 33 that may include a pocket 33*b* and an exit hole 33*a* on which a stem 34 is disposed to serve as a check valve. A cylindrical shaped stem 34 may include a head 34*a* to sit on the hole 33*a*, a radial flange 34*b* to hold a smaller diameter end of a conical spring 43, and a split 34*c*. The spring 43 keeps the stem 34 close the exit hole 33*a* to prevent the fluid from flowing freely but allows the fluid flow when the bottle is pressurized. The cap 22 may form an annular tongue/groove 44 from which a separate nozzle body 1F may be detachably mounted, wherein the brush assembly 1C may be mounted within the body 1F.

The tongue/groove 44 may be replaced by an internal/external thread arrangement. The interchangeability feature of the nozzle body 1F from/on the cap 22 with or without a provision of a simple check valve enables the applicator 1A for many fluid dispensing applications. Application of these brush applicators 1A and 1E with or without a check valve may include dispensing wooden glues, paintings for art/crafts, fluxes for soldering, and primer/solvent-glues for PVC and ABS pipes, for example.

Figure 5:
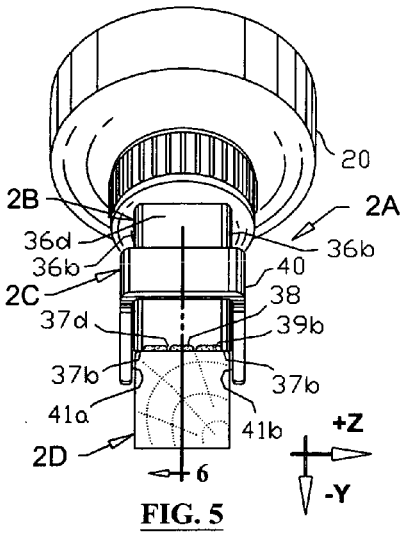
FIG. 5 is a front view of a second exemplary embodiment 2A of a first edge applicator implement with a guide assembly 2C showing the adhesive applied only on the edge surface of the workpiece.
Figure 6:
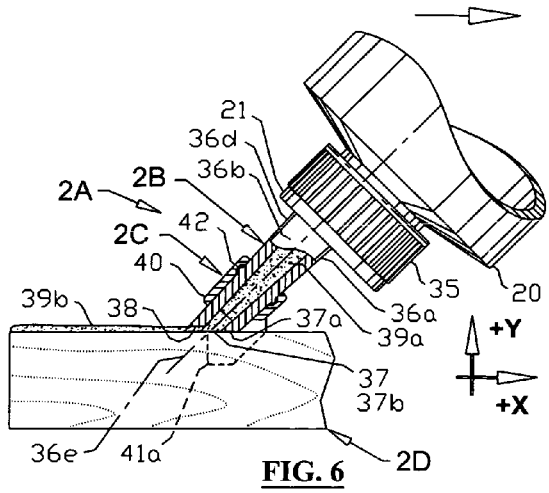
FIG. 6 is a side and partial cross-sectional view taken along line 6 of FIG. 5. The first edge applicator 2A shows that adhesive flows evenly through the nozzle end notch to dispose an even layer of adhesive.

An edge applicator implement 2A (or a body thereof) in a second exemplary embodiment according to the present invention is illustrated as a front view in FIG. 5 and a side and partial cross-sectional view in FIG. 6. A mounting means or a cap 35 of edge applicator 2A as shown in FIGS. 5 and 6 is mounted to a container or a bottle 20. A nozzle 2B formed in the cap 35 has a first or an inlet end and a second or outlet end and may be nose shaped longitudinally, rectangular shaped at its cross section having a fore wall 36*d*, a aft wall 36*a* and two sidewalls 36*b*, wherein the outlet end terminates forming an slant plane 37 by at least two side planes 37*b* that are perpendicular to the sidewalls 36*b*. An aft plane 37*a* that terminated from the aft wall 36*a* at the outlet end may form a co-plane with the slant plane 37 resulting in completing a U-shaped plane. The outlet end may form a rectangular shape. There is an axis 36*e* that may be parallel to the sidewalls 36*b* and in between the fore wall 36*d* and aft wall 36*a*.

There may be at lease one relief channel or aft notch 38 at the outlet end where adhesive can flow forming an adhesive band 39*b* in between partition walls 37*d* or in between side plane 37*b* and partition wall 37*d* when the slant plane is placed on the surface edge of workpiece 2D. For better visibility, even flow of the adhesive, and/or control of the height of the adhesive thickness, the angle between the axis 36*e* and the slant plane 37 may be set between 30° and 75°. The height of the aft notch 38 is between approximately 0.025 cm (0.01 inch) and approximately 0.305 cm (0.12 inch) and the lateral width of two side edges 37*b* is between approximately 0.635 cm (0.25 inch) and approximately 6.35 cm (2.50 inches).

To dispense adhesive only on the edge surface of the workpiece 2D, it is desirable to prevent the nozzle 2B from moving laterally (+/−Z axis in FIG. 5). A nozzle adapter 40 of a guide assembly 2C may be detachably mounted on the outside walls 36*a*, 36*b* and 36*d* and provided with longitudinally extending guides 41*a* and 41*b* below the slant plane 37 to slide with respect to two sidewalls of workpiece 2D. Use of only one guide 41*a* formed in the adapter 40 can be used for a wider workpiece. Furthermore, the outer wall of the nozzle 36 may be provided with a detent 42 corresponding to the inner wall of adapter 40 for the guide assembly 2C to stay firm when assembled. At least one of guides 41*a* and 41*b* may be mounted onto the side wall(s) 36*b*.

Therefore, the adhesive flows from bottle 20 though a passage or a channel 39*a* as it is being gently squeezed and reaches the slant plane 37 and exits through the aft notch(s) 38 whose shape is generally wide in a lateral direction (Z axis in FIG. 5) but thin in a vertical direction (Y axis). By moving the edge applicator 2A in the right hand direction (+X axis in FIG. 6) the adhesive exits in a confined lateral direction by one or two guides 41*a* and 41*b*. A thin band(s) glue layer 39*b* is applied only on the edge surface without any adhesive spilling on either side (−Y axis in FIG. 5) of the workpiece 2D.

Figure 7:
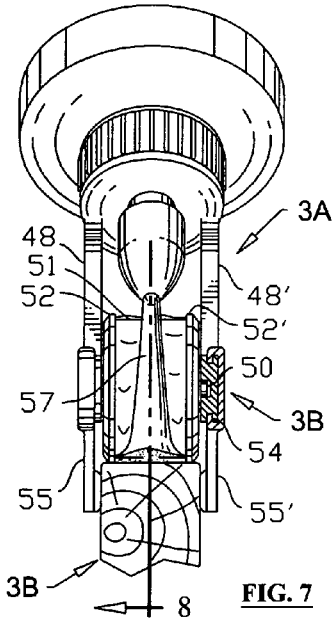
FIG. 7 is a front view of a third exemplary embodiment 3A of a second edge applicator implement with two detachable guides 3B showing the glue dispensed through a roller only onto the edge surface of the workpiece.
Figure 8:
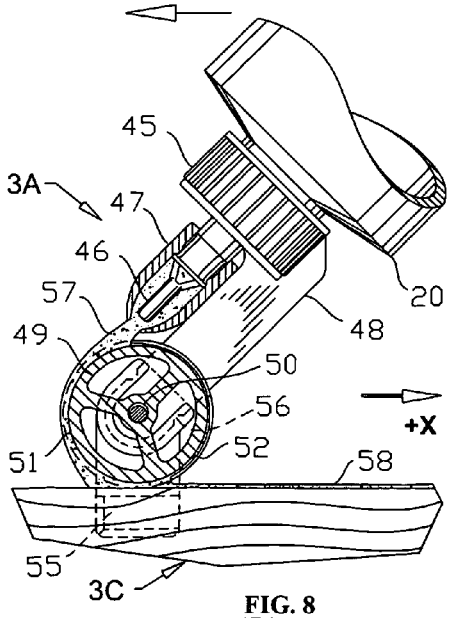
FIG. 8 is a side and partial cross-sectional view taken along line 8 of FIG. 7. The second edge applicator 3A shows that adhesive flows evenly through the roller to dispose an even layer of adhesive.

A roller applicator implement 3A (or a body thereof) in a third exemplary embodiment according to the present invention is illustrated as a front view in FIG. 7 and a side and partial cross-sectional view in FIG. 8. The cap 45 of edge applicator 3A as shown in FIGS. 7 and 8 is mounted to a bottle 20. The cap may have two side brackets 48 and 48' that extend to hold a roller 49 that is held by a shaft 50 at the other end. The roller 49 has two opposing circumferential side flanges 52 and 52' and a circumferential recess 51 in-between. The other end of cap 45 may have a post 46 which can be shut or opened for the glue to flow by sliding a pouring spout 47. Two side guides 55 and 55' may be attached by groove 54 and detents 56 to the side brackets 48 and 48' when they are in use. Glue exits from the end of pouring spout 47 and forms a bead pattern 58. Further movement of the edge applicator 3A in the left hand direction (−X axis in FIG. 8) generates a uniform glue layer 58. The gap between flanges 52 and 52' and the circumferential recess 51 make this uniform glue layer in-between. Therefore, a uniformly thin yet controlled layer of glue 58 is applied only on the edge surface of the workpiece 3C.

The readily detachable feature of the guide assembly 2C from nozzle 2B in FIGS. 5 and 6, and the guide 3B from applicator 3A in FIGS. 7 and 8, enable the edge applicators 2A and 3A to be used for the dispensing of adhesive or glue on a flat surface or on grooves that are widely used for the wood tongue/grove joints.

Figure 9:
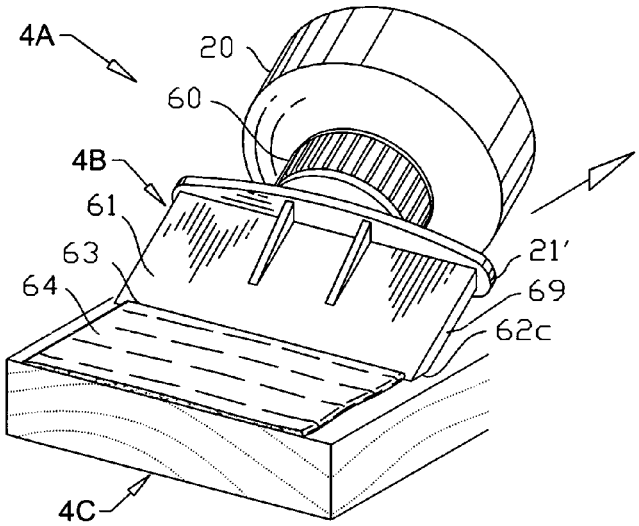
FIG. 9 is a perspective view of a fourth exemplary embodiment 4A of a flat surface applicator implement.
Figure 10:
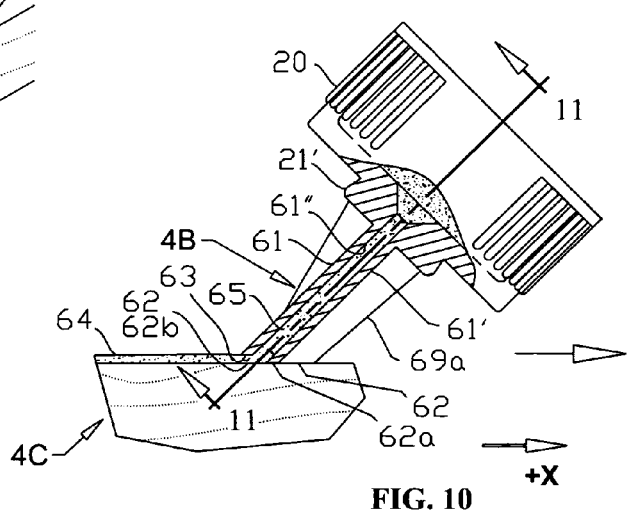
FIG. 10 is a side and partial cross-sectional view of FIG. 9.
Figure 11:
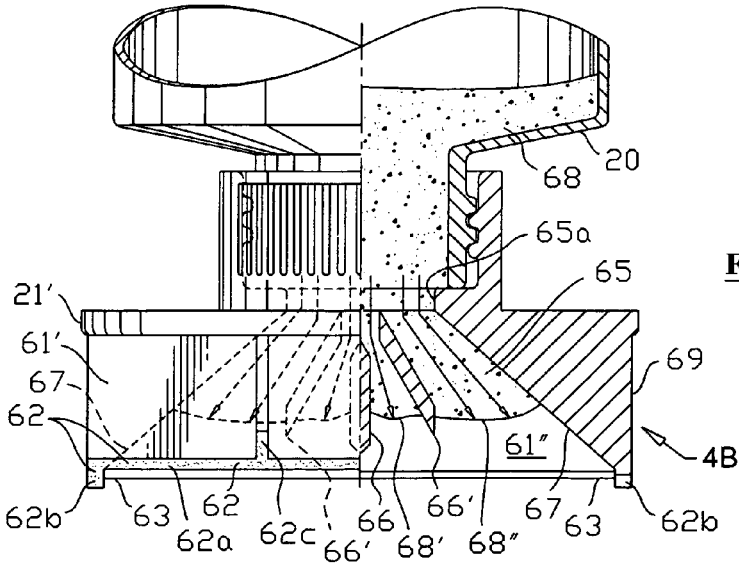
FIG. 11 is a cross-sectional view taken along line 11-11 of FIG. 10.

A flat surface applicator implement 4A (or a body thereof) in a fourth exemplary embodiment according to the present invention is illustrated as a perspective view in FIG. 9, a side and partial cross-sectional view in FIG. 10 and a rear and partial cross-sectional view in FIG. 11.

The surface dispenser implement 4A includes a mounting means or a cap 60 mountable to a container or a bottle 20. A nozzle 4B formed in the cap 35 has a first or an inlet end 65*a* and a second or outlet end that comprised of a slant plane 62 and an aft notch 63. The nozzle 4B may be rectangular shaped at its cross section having an aft wall 61, a fore wall 61' and two side or transverse walls 69 from the inlet end 65*a* and terminates forming the slant plane 62 that is comprised of a fore plane 62*a* and two side planes 62*b* that are perpendicular to the transverse walls 69. There is an oval rim 21' near the inlet end on peripheral of the cap. A relief channel or aft notch 63 from extension of the aft wall 61 at the outlet end though where adhesive can flow forming an adhesive layer 64. A passage or a channel 65 is formed by two walls 61 and 61' and two diverged sidewalls 67, wherein there may be a central vane 66, two opposingly and angularly positioned vanes 66' in between two walls 61 and 61'. The two vanes 66' help diverge the flow of the adhesive evenly and widely to reach the end area of sidewalls 67 near side planes 62*b*.

The progressive adhesive, particularly wood glue, flow pattern is shown in FIG. 11; as shown on the right hand side of the figure, the adhesive 68 flows from the bottle 20 as it is gently squeezed and is diverged by vanes 66 and 66' inside of channel or passage 65 to flow evenly and widely until it reaches to the slant plane 62. The space between the central vane 66 and vane 66' guide divided glue 68', and the guide 66' and diverged wall 67 guide another divided glue 68". There is an aft notch 63 at the end of aft wall 61 and the adhesive is contained inside of the slant plane 62 where adhesive can flow out when the slant plane 62 is placed on the surface of workpiece 4C. The angle between the channel 65 and the slant plane 62 is set between approximately 30° to approximately 75° for better visibility and for even flow of the glue as shown in FIG. 10. To maintain stable angular relationship with the workpiece 4C, the nozzle 4B may have at least one support 69*a* that are formed on fore wall 61' and form an extended plane 62*c*, which provides the complete slant plane 62. By moving the surface applicator 4A in the right hand direction (+X axis in FIG. 10) the glue exits through the aft notch 63, resulting in a thin glue layer 64 dispensed on the surface of workpiece 4B as shown in FIGS. 9 and 10.

Figure 12:
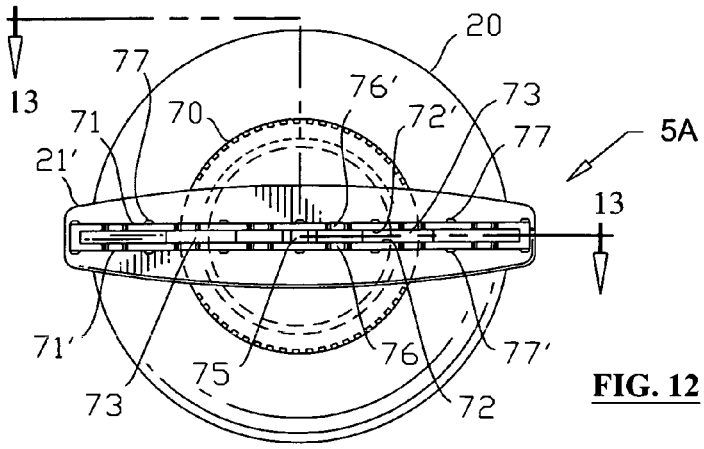
FIG. 12 is a top view of a fifth exemplary embodiment 5A of a first biscuit applicator implement.
Figure 13:
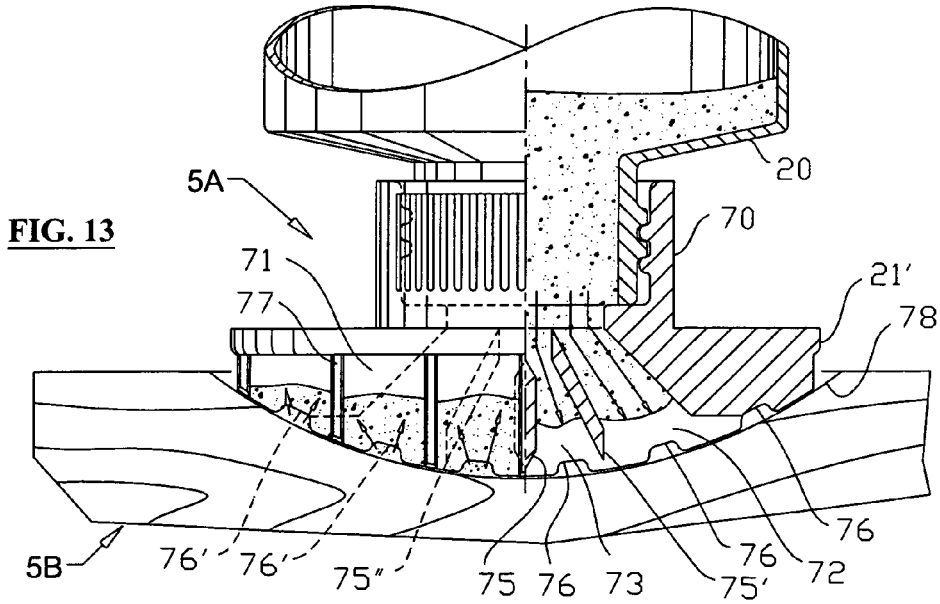
FIG. 13 is a sectional view taken along line 13-13 of FIG. 12.

A biscuit applicator implement 5A (or a body thereof) in a fifth exemplary embodiment according to the present invention is illustrated as a top view in FIG. 12 and a front and partial cross-sectional view in FIG. 13, which may be extended its layouts from the flat surface applicator 4A. The cap 70 of the biscuit applicator 5A as shown in FIGS. 12 and 13 is mounted to a bottle 20 and forms a generally oval shape end corresponding to the elliptical slot 78 cut by biscuit cutters in workpiece 5B. As shown in FIGS. 12 and 13, plural channels 73 are located between two inner sidewalls 72 and 72' that are strengthened/connected by a central vane 75 and two opposingly positioned vanes 75' and 75".

Figure 16:
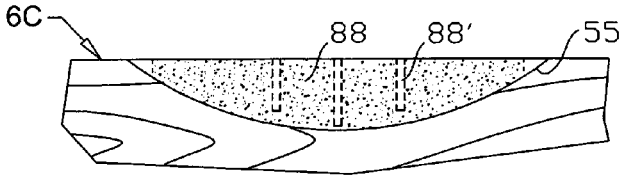
FIG. 16 is a longitudinal sectional view showing an elliptical slot of a workpiece 6*c* after the application of the biscuit applicator 5A or 6A.

The glue flows from the bottle 20 as it is gently squeezed and is directed/distributed by vanes 75 and 75' to flow substantially evenly until reaching near the elliptical slot 78. Further travel of glue flows over plural passes 76' and fills spaces between outer walls 71 and 71' and between plural projections 77 and 77'. The distance between the set of plural opposingly located projections 77 and 77' is slightly narrower than the width of elliptical slot 78. This progressive flow pattern is shown in FIG. 13. The right half of FIG. 13 shows the flow of glue prior to contacting the elliptical slot 78, and the left half shows the flow of glue after flowing over the passes 76'. The glue layer 88 generated onto the workpiece 6C by this applicator 5A is shown in FIG. 16.

Figure 14:
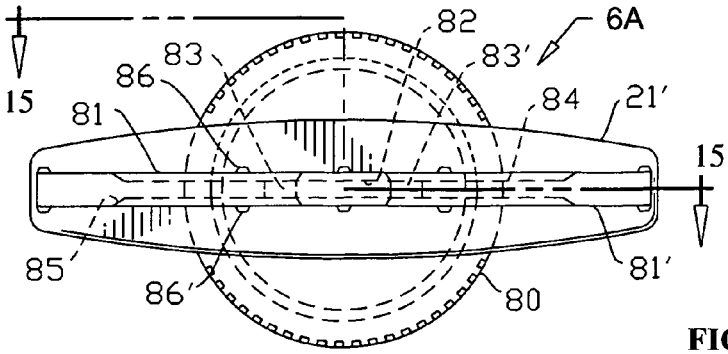
FIG. 14 is a top view of a sixth exemplary embodiment 6A of a second biscuit applicator implement.
Figure 15:
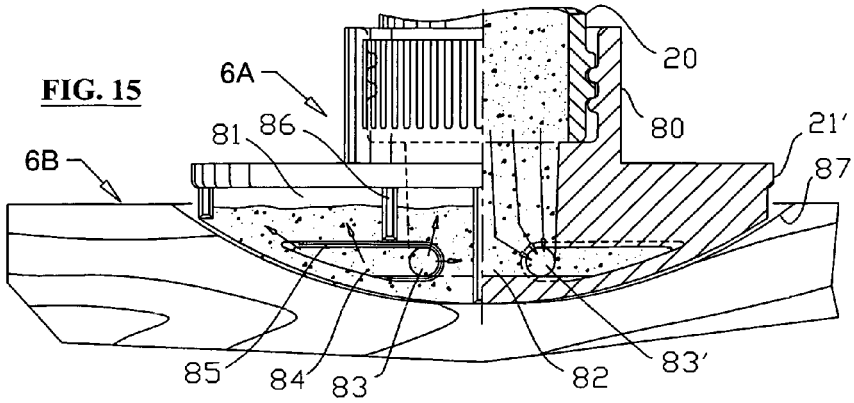
FIG. 15 is a sectional view taken along line 15-15 of FIG. 14.

A biscuit applicator implement 6A (or a body thereof) in a sixth exemplary embodiment according to the present invention is illustrated as a top view in FIG. 14 and a front and partial cross-sectional view in FIG. 15. The cap 80 of the biscuit applicator 6A as shown in FIGS. 14 and 15 is mounted on a bottle 20 and forms a generally oval shaped end corresponding to the elliptical slot 87 cut by biscuit cutters in workpiece 6B. As shown in FIGS. 14 and 15, the glue flows from the bottle 20 as it is gently squeezed into a channel 82, and passes through plural transverse orifices 83' that are at a normal angle to outer wall 81' as shown in the right hand side of FIG. 15. As the glue passes through the plural transverse orifices 83, it fills/spreads two opposingly located slots 84, travels through chamfers 85, then fills two opposite spaces between outer walls 81 and 81', and plural projections 86 and 86'. This progressive flow pattern is shown in FIG. 15; the right half of the figure shows the flow of glue prior to contacting the elliptical slot 87, and the left half shows the flow of glue after flowing over the transverse orifices 83 and slots 84. The glue layer 88 generated onto the workpiece 6C by this applicator 6A is shown in FIG. 16. FIG. 16 is a longitudinal sectional view showing an elliptical slot of a workpiece 6C with glue layer 88 and non-glue lines 88' after using the biscuit applicator 5A or 6A.

Figure 18:
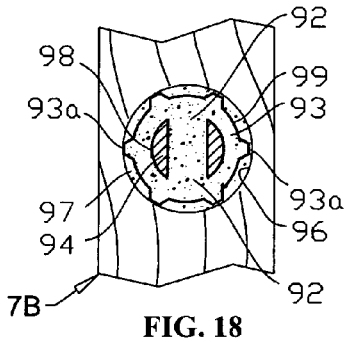
FIG. 18 is a cross-sectional view taken along line 18-18 of FIG. 17.
Figure 17:
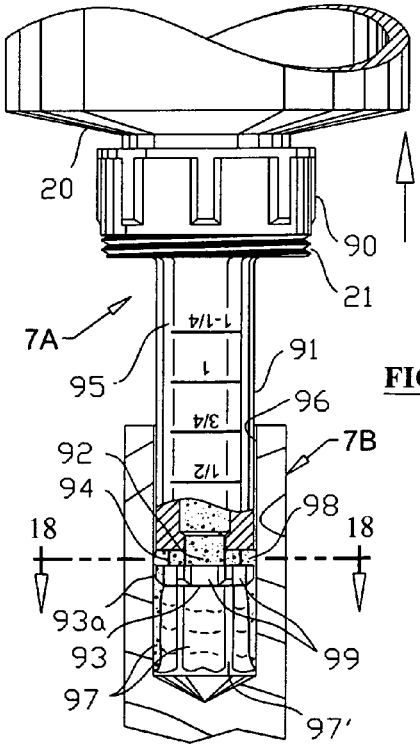
FIG. 17 is a front and partially sectional view of a seventh exemplary embodiment 7A of a dowel applicator implement.

A dowel applicator implement 7A (or a body thereof) in a seventh exemplary embodiment according to the present invention is illustrated as a front view in FIG. 17; FIG. 18 shows a cross-sectional view taken along line 18-18 of FIG. 17. The cap 90 of the dowel applicator 7A as shown in FIG. 17 is mounted to a bottle 20 and may form a cylindrically shaped end corresponding to a round hole wall 96 cut by drill bits in workpiece 7B. The diameter of the cylindrical nozzle 91 and circumference of plural projections 93*a* are sized to fit/slide into the round hole wall 96. The end of body 7A may have two yokes 94 that connect the nozzle 91 and a tip 93. The yokes 94 may be configured to provide two opposing orifices 92 and first recesses 98 circumferentially compared to the circumference of the nozzle 91 to distribute glue evenly over second recesses 99. The tip 93 may have six projections 93*a* that may be of the same diameter as the nozzle 91 and second recesses 99 in between projections 93*a*.

As the bottle 20 is gently squeezed and lifted up, the glue flows through the orifices 92, fills the gap between the wall 96 and the first recesses 98, and travels through plural spaces among the wall 96, the second recesses 99 and projections 93*a*, resulting in plural glue layers 97 and non-glue lines 97'. The non-glue lines 97' will eventually disappear and leave a uniform layer of glue on the round hole wall 96. The outer surface of nozzle body 91 may have plural indicia 95 for the user to check the depth of the hole 96 prior to gluing and dowel insertion.

Figure 19:
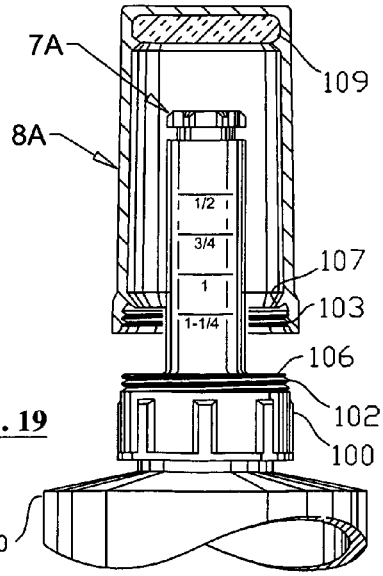
FIG. 19 is a cross sectional view of an eighth exemplary embodiment 8A of a wet well implement showing that the wet well 8A is fitted on to the dowel applicator 7A.

A wet well implement 8A (or a body thereof) in an eighth exemplary embodiment according to the present invention is illustrated as a sectional view in FIG. 19, which is mounted onto the dowel applicator 7A. The body 8A may be generally cup shaped with one end having an opening that fits tightly on the rim of the cap 100 and the other end having affixed a water/solvent retainer 109 such as a sponge or felt material. Often the adhesive applicators are unused for hours without cleaning the nozzles, pathways, channels, tips or brushes; this may result in hardened glue that ruins the applicator. The inner wall of circumferential opening area may be formed with an internal thread 103 in wet well 8A to engage with an external thread 102 formed on the top of cap 100 to provide an air seal, which also may be achieved by a circumferential tongue that replaces the internal thread 103 and a circumferential groove that replaces the external thread 102. Furthermore, when an inwardly/downwardly extended circumference flange lip 107 contacts with the cap top surface 106, it helps to have an airtight seal. The water/solvent retainer 109 with drops of water/solvent provides the inner space of wet well 8A to be saturated with moisture/solvent to prevent from hardening glue or adhesive within the wet well, which houses many different type of applicators. The wet well 8A may be mounted on the circular rim 21 of the applicator 1A and in FIG. 1 and of the edge applicator 2A in FIG. 5. Oval rims 21' located aft the cap 60, 70 and 80 as shown in FIGS. 9 through 15 can also readily accommodate oval shaped cups with a water/solvent retainer in it to achieve the same purpose.

The entire embodiments as shown in FIGS. 1-19 may be constructed by inexpensive thermoplastics, except valve 31 in FIG. 2A, brush assembly 1C in FIG. 3A, 1D in FIG. 3B, and the water/solvent retainer 109 in FIG. 19.

Figure 20:
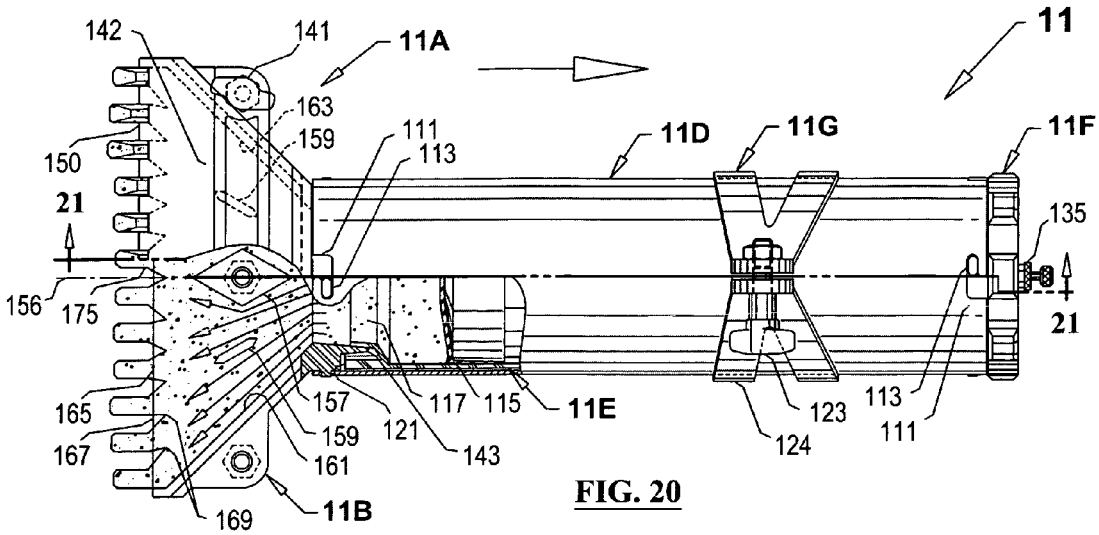
FIG. 20 is a top and partial cross-sectional view of a ninth exemplary embodiment 11 of an adhesive dispenser implement for high viscous material.
Figure 21:
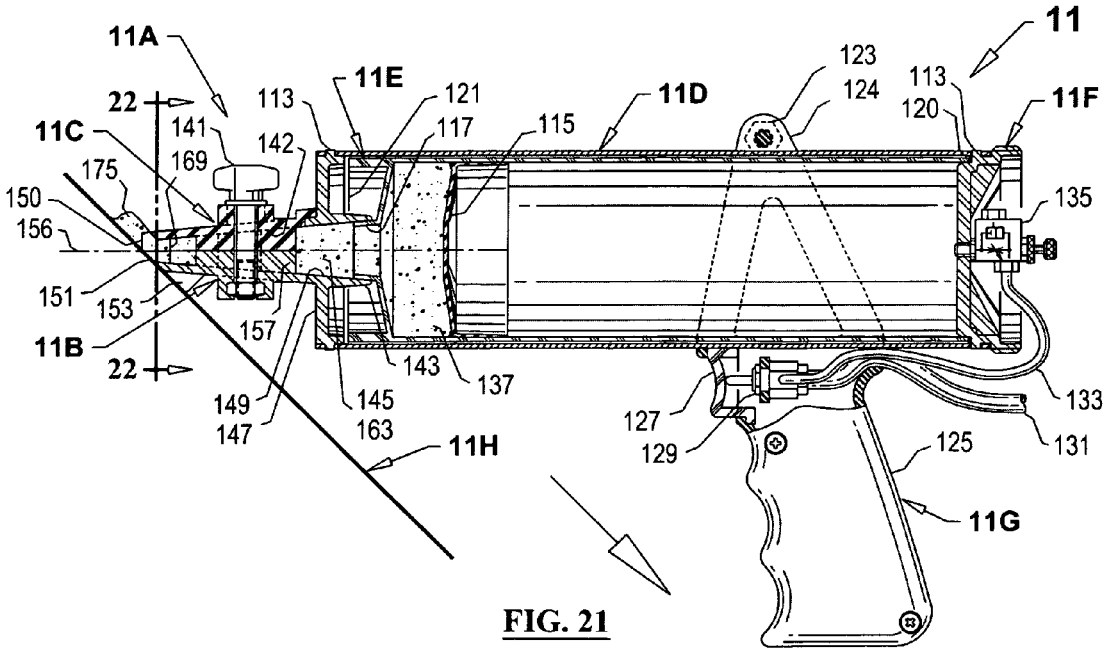
FIG. 21 is cross-sectional view taken along line 21-21 of FIG. 20. The ninth adhesive dispenser 11 shows that mortar flows onto the workpiece.
Figure 22:
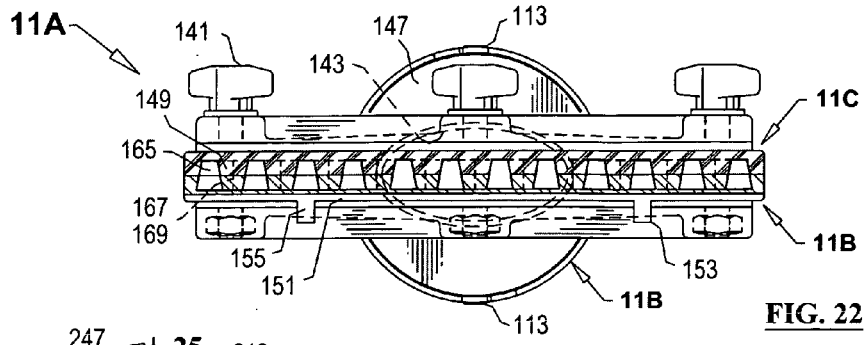
FIG. 22 is cross-sectional view taken along line 22-22 of FIG. 21.

A viscous-material dispenser implement 11 (or a body thereof) in a ninth exemplary embodiment according to the present invention is illustrated as a top and partial cross-sectional view in FIG. 20, a cross-sectional view in FIG. 21 and a cross-sectional view in FIG. 22.

As shown in FIGS. 20-22, the mortar applicator implement 11 comprises a nozzle assembly or a nozzle 11A that is mounted in a forward end of a barrel 11D, a handgrip assembly 11G mounted on outer surface of the barrel 11D, a container or a cartridge 11E that is slidably placed inside of the barrel 11D, and an rear end cap 11F that secures the cartridge 11E and mounted in a rear end of the barrel 11D. The nozzle 11A may comprise of a fore nozzle 11B and an aft nozzle 11C.

Referring to FIGS. 20-22, both front and rear end of the barrel 11D may have a plurality of L-shaped locking collars 111 in a radial direction. The round peripheral surfaces of the aft nozzle 11B and the end cap 11 may have corresponding locking pins 113 with which a user can quickly insert the nozzle 11A and the end cap 11F into corresponding barrel 11D followed by rotating and locking the end cap 11F. The cartridge 11E may be of conventional tubular type including an axially slidable piston 115 and contains a supply of viscous-material or adhesive such as a mortar therein. The cartridge 11E has the rear end cylindrical wall and a tapered spout 117 coaxially recessed from a front end 119. A O-ring type gasket 120 may be placed in between the rear end wall of the cartridge and the end cap 11F to prevent air from leaking. The front end of spout 117 is recessed axially rear toward with respect to the front end 119, which helps prevent damage of the cartridge 11E from handling.

The handgrip assembly 11G is comprised of a set of band 124 that holds the barrel 11D by loosing and tightening the screw/nut 123, a handgrip 125 on which the band 124 is disposed, a trigger 127 mounted in the handgrip to actuate an actuation valve 129, a first hose 131 that supplies pressurized/regulated air to the actuation valve 129, and a secondary hose 133 that feeds the pressurized air from the actuation valve 129 to an integral valve assembly 135 that is mounted on the end cap 11F to supply the pressurized air to fill the space within the cartridge 11E, which results in pushing the viscous-material 137 through the spout 117 by the piston 115. The handgrip assembly 11G may be rotatably and slidably mounted with respect to the barrel 11D by loosing and tightening the screw 123. The integral valve assembly 135 may have a flow control and a quick exhaust therein.

The nozzle 11A may be triangular shaped longitudinally, rectangular or partial arch shaped at its cross section and is comprised of a fore nozzle 11B and an aft nozzle 11C that may be removably mounted by screw/nets 141 or bonded onto the fore nozzle 11B. The screw/nets 141 may be replaced by any other suitable means such as a T-bolt with a cam handle for a quick assembly. The aft nozzle 11C provides at lease one aft wall 142.

The fore nozzle 11B has a first end or an inlet end 143 that is adapted to engage/connect to the cartridge spout 117, a tapered passage or channel 145, a round disc 147 that is radially extended from outer wall of the channel 145 and has pins 113 on its rim and a fore wall 149, a second end or an outlet end 150 where the viscous-material 137 exits, and a slant plane 151 formed at the outlet end 150. To maintain stable angular relationship with the workpiece 11H, the nozzle 11B may have at least one bracket 153 that are formed on fore wall 149 and form an extended plane 155, which provides the complete slant plane 151. An axis 156 may be coaxial to the cartridge 11E. For better visibility, even flow of the mortar, and/or control of height of mortar thickness, the angle between the axis 156 and the slant plane 151 may be set approximately between 30° and 75°. There may be a central vane 157 and two opposingly and angularly positioned vanes 159 in between two diverged sidewalls 161 and 163, which may be formed in inner wall of the either fore nozzle 11B or aft nozzle 11C, or shared by both the nozzles 11B and 11C as shown in FIGS. 21 and 22. The outlet end 150 is laterally wide, as shown on FIGS. 20 and 22, has a plurality of discharge orifices 165 that are disposed in between partition walls 167. Each partition wall 167 may have tapered edge 169, which is formed in between the fore wall 149 and the aft wall 142 and may face toward to the spout 117. The shape of each orifice 165 may be a triangle, a truncated triangle, a rectangle, a circle, a truncated circle, an oval or a truncated oval, which can be selected to suit best for a particular bead type requirement and viscosity. The inlet end 143 is adapted to engage to the inner wall of tapered spout 117 and the shape of cross section may be rectangular, circular or oval shape.

It should be apparent, from the figures, that the large cross section area of the spout 117 and that of the inlet end 143 of the nozzle 11A compared to commercial adhesive cartridge helps reduce the force required to push the viscous-material 137. Therefore, the cross section area of the spout 117 may be at least 10% compared to that of the cartridge 11E cylindrical body.

In FIG. 21, the actuation force to push the piston 115 is demonstrated with use of presurized air, which may be commercial caulking guns that include hand actuated types and a battery powered dispensing gun as disclosed in U.S. Pat. No. 4,669,636.

The substrate or workpiece 11H may be a horizontal floor surface on which adhesives can be dispensed for the installation of ceramic tile, vinyl sheet, carpet or wood flooring material thereon. By dispensing adhesives on backside of the workpieces, particularly ceramic tiles, on a horizontal flat surface, the workpieces can be installed on a vertical wall instead of dispensing the adhesives directly on a vertical wall.

In order to utilize the dispenser implement 11 of the present invention, slide the inlet end 143 of the nozzle body 11C into the cartridge spout 117 and insert them into the barrel 11D through, twist and lock the disc 147 with respect to the barrel 11D with the pins 113 into the locking collar 111, and insert the end cap 11F from rear end of the barrel 11D. The first air hose 131 is connected to the actuation valve 127 that releases the pressurized air to the second hose 133 by pressing the trigger 127. The air reaches to the inside chamber in the cartridge 11E after passing the integral valve 135, wherein the feed rate of the bead 175 of the viscous-material can be controlled by adjustment of the flow rate control. The piston is forwarded to push the viscous-material 137 to flow through the channel 145, followed by diverging by vanes 159 to flow evenly and widely until it reaches to the outlet end 150. The viscous-material 137 exits from orifices 165 and reaches on the workpiece 11H when the dispenser is moved from left top to right bottom as shown in FIG. 21. The slant plane 151 provides for a user easy to place the dispenser implement 11 on the workpiece resulting in a consistent bead height. After use of the dispenser implement 11, adhesive remnant left inside of nozzle 11A may be cleaned with a brush after removal of the aft nozzle 11C from fore nozzle 11B.

Figure 23:
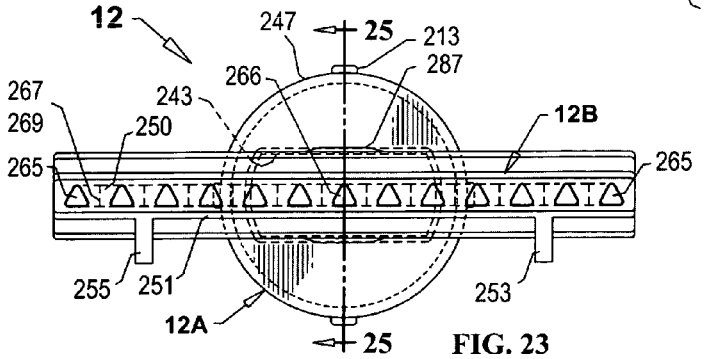
FIG. 23 is a front view of a tenth exemplary embodiment 12 of an adhesive dispenser implement showing only a nozzle.
Figure 24:
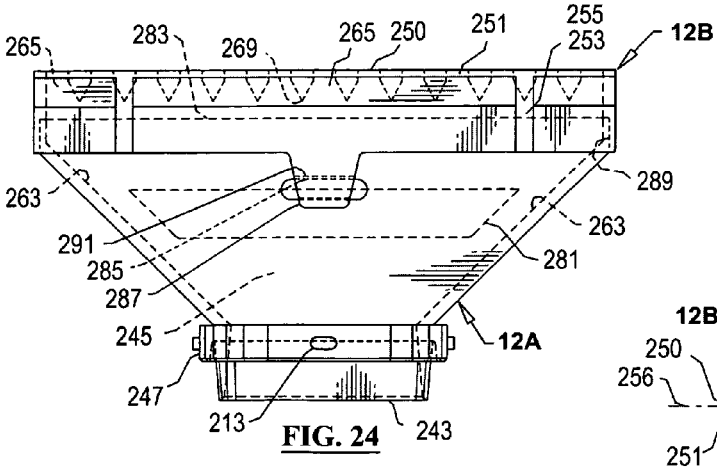
FIG. 24 is a bottom view of FIG. 23.
Figure 25:
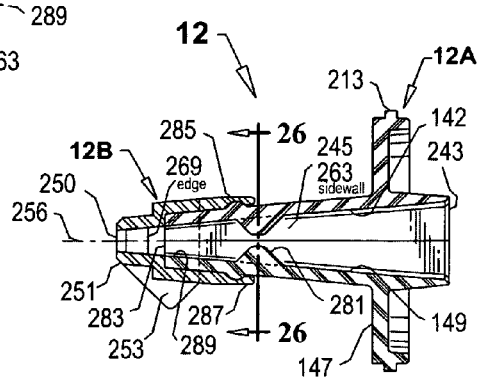
FIG. 25 is cross-sectional view taken along line 25-25 of FIG. 23.
Figure 26:
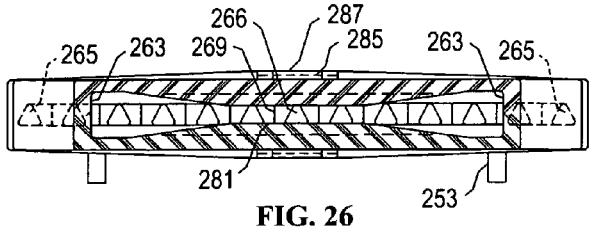
FIG. 26 is cross-sectional view taken along line 26-26 of FIG. 25.

A viscous-material dispenser implement 12 (or a body thereof) in a ninth exemplary embodiment, especially a nozzle assembly, according to the present invention is illustrated as a front view in FIG. 23, a bottom view in FIG. 24, a cross-sectional view in FIG. 25 and a cross-sectional view in FIG. 26.

As shown in FIGS. 23-26, a nozzle assembly or a nozzle 12 comprises a nozzle body 12A on which a nozzle head 12B is detachably mounted. A disc 247 has a plurarity of locking pins 213 on its round peripheral surface, which enables the nozzle body 12A mounted into the barrel 11D that is shown in FIGS. 20 and 21.

Referring to FIGS. 23-25, the nozzle body 12A may comprise of a disc 247, an inlet end 243 that is adapted to a container or a cartridge, an outlet end where the viscous-material exits, a fore wall 249, an aft wall 242, two side walls 263, a laterally elongated opening 283, a passage or a channel formed among the fore wall 249, the aft wall 142, and the side walls 263, and a flow restraint 281 in between the inlet end 243, at least one detent 285 on outside wall of either aft wall 242 and fore wall 249, and the elongated opening 283 whose cross section is generally a rectangular shape.

The nozzle 12A may be triangular shaped longitudinally, rectangular or partial arch shaped at its cross section and may be constructed by two pieces with respect to axis 256 as shown in FIGS. 24 and 25. In FIGS. 24 and 25, the nozzle head 12B may be a U-shaped at its cross section and have a pocket 289 adapted to engage with the opening 283.

The nozzle head 12B is comprised of a pocket 289, a plurality of discharge orifices 265 that are disposed in between partition walls 267, a tapered edge 269 in each partition wall 267, at least on finger 287 with a groove 291 that is adapted to engage with the detent 285, and at least one bracket 253 that are formed on outer wall to form an extended plane 255, which provides the complete slant plane 251.

FIG. 20 shows a central vane 157 and two angularly positioned slant vanes 159 to distribute the viscous-material laterally, which can also be achieved by a introduction of at lease a flow restraint 281 formed on the fore and aft walls 242 and 249 as shown in FIGS. 24-26. In FIGS. 25 and 26, the flow restraint 281 is a dam or a bumper shaped longitudinally and has a variable cross section area laterally for the viscous-material to reach evenly to each orifice 265 that are formed in the outlet end 250.

The advantage of the flow restraint 281 is easy to clean a remnant material left inside of channel 245 and easy flow of the viscous-material because of smooth surfaces. The provision of detachably mountable means of the nozzle head 12B onto the nozzle 12A enables for the user not only to select a specific nozzle head 12B that have a specific shape of orifices 265 for a different job requirements, but also to replace only the worn out nozzle head 12B.

The nozzle 11A and 12 as shown in FIGS. 20-26 may be constructed by (semi) transparent thermoplastics or cast metal.

It will be appreciated by those of ordinary skill in the art that the invention can be embodied in other specific forms without departing from the spirit or essential character hereof. The present description is therefore considered in all respects to be illustrative and not restrictive. The scope of the invention is indicated by the appended claims, and all changes that come within the meaning and range of equivalents thereof are intended to be embraced therein.

What is claimed is:

1. A device for dispensing an adhesive onto a workpiece, moving relative to the workpiece and used cooperatively with an adhesive container, comprising:

a nozzle for dispensing the adhesive, said nozzle having an inlet end which is configured to receive the adhesive ejected from said container;

a fore wall and an aft wall, which are connected to said inlet end;

an outlet end having at least one orifice and located on the opposite side from said inlet end;

a passage formed in said nozzle between said inlet end and said outlet end to direct the adhesive, wherein said passage defines an axis;

two sidewalls disposed laterally and connected to said inlet end and said outlet end;

a slant plane disposed near said fore wall, said slant plane for permitting said nozzle to urge on the workpiece, wherein an angle formed by said axis and said slant plane is between 30° and 75°, and an aft notch disposed at said orifice, said aft notch for permitting to dispense a controlled layer of adhesive on the workpiece.

2. The device of claim 1, wherein said two sidewalls and said outlet end form a triangular shape.

3. The device of claim 2, further comprising means disposed in said passage for permitting the adhesive to flow laterally toward said sidewalls near said outlet end, wherein said means includes at least one of at least one flow restraint or at least one vane, said flow restraint having a lateral variable cross section.

4. The device of claim 1, wherein said orifice is detachably mounted on said outlet end.

5. The device of claim 1, wherein said orifice is selected from a group consisting of a triangle, a truncated triangle, a rectangle, a circle, a truncated circle, an oval and a truncated oval.

6. The device of claim 1, wherein at least one of said aft wall or said fore wall is removably mounted on said nozzle.

7. A device for dispensing an adhesive onto a workpiece, moving relative to the workpiece and used cooperatively with an adhesive container, comprising:

a nozzle for dispensing the adhesive having an inlet end which is configured to receive the adhesive ejected from said adhesive container;

a fore wall and an aft wall, which are connected to said inlet end;

an outlet end having a plurality of orifices and located on the opposite side from said inlet end;

two sidewalls disposed laterally and connected to said fore wall and said aft wall, said two sidewalls and said outlet end form a triangular shape;

a passage defining an axis, said passage formed by said fore wall, said aft wall and said two sidewalls, and means for permitting the adhesive to flow laterally toward said sidewalls near said outlet end.

8. The device of claim 7, further comprising a slant plane disposed near said outlet end, wherein an angle formed by said axis and said slant plane is between 30° and 75°.

9. The device of claim 7, wherein said orifices are selected from a group consisting of a triangle, a truncated triangle, a rectangle, a circle, a truncated circle, an oval and a truncated oval.

10. The device of claim 7, wherein at least one of said aft wall or said fore wall is removably mounted on said nozzle.

11. The device of claim 7, wherein means include at least one of at least one flow restraint or at least one vane, said flow restraint having a lateral variable cross section.

12. The device of claim 7, wherein said orifices are detachably mounted on said outlet end.

* * * * *